US007493903B2

(12) United States Patent
Rogers et al.

(10) Patent No.: US 7,493,903 B2
(45) Date of Patent: Feb. 24, 2009

(54) ADJUSTABLE HAIR HOLDING DEVICE

(75) Inventors: Bruce A. Rogers, 19 Bank St., Suite 406, Philadelphia, PA (US) 19106; David Livingston, Pennsburg, PA (US)

(73) Assignee: Bruce A. Rogers, Philadelphia, PA (US)

( * ) Notice: Subject to any disclaimer, the term of this patent is extended or adjusted under 35 U.S.C. 154(b) by 0 days.

(21) Appl. No.: 10/763,846

(22) Filed: Jan. 23, 2004

(65) Prior Publication Data

US 2004/0182411 A1 Sep. 23, 2004

Related U.S. Application Data

(60) Provisional application No. 60/486,485, filed on Jul. 11, 2003, provisional application No. 60/472,953, filed on May 23, 2003, provisional application No. 60/444,926, filed on Feb. 4, 2003, provisional application No. 60/442,205, filed on Jan. 24, 2003.

(51) Int. Cl.
*A45D 8/20* (2006.01)

(52) U.S. Cl. ..... 132/277

(58) Field of Classification Search ..... 132/276, 132/277, 279, 273; 606/157–158; 24/67.7, 24/505–506, 517–518; 63/14.4–14.5
See application file for complete search history.

(56) References Cited

U.S. PATENT DOCUMENTS 870,330 A * 11/1907 Wilde ..... 63/14.4
2,008,382 A * 7/1935 Bennett ..... 63/14.4
2,405,025 A * 7/1946 Feingold ..... 63/14.4
2,947,054 A * 8/1960 Adams ..... 24/518
3,546,750 A * 12/1970 Sheehan ..... 24/16 R
5,170,644 A * 12/1992 Calabro ..... 63/14.4
5,549,127 A * 8/1996 Chang ..... 132/277
6,082,371 A * 7/2000 Bader-Saltzman et al. .. 132/276
6,357,452 B2 3/2002 Bolito

FOREIGN PATENT DOCUMENTS

WO WO 02/058504 * 8/2002

* cited by examiner

*Primary Examiner*—Cris L Rodriguez
*Assistant Examiner*—Rachel A Running
(74) *Attorney, Agent, or Firm*—John F. Letchford; Archer & Greiner, P.C.

(57) ABSTRACT

A hair holding device including hingedly connected first and second body members each including hair gripping portions adapted to be squeezed by a user whereby the hair gripping portions come into contact with gathered strands of a user's hair. The device further includes a friction-type adjustment mechanism coaxially arranged with respect to the hinge for causing the hair gripping portions to remain at a point at which the hair gripping portions are squeezed together by a user. Optionally, the device may include squeezable release handles or other release mechanism, as well as a torsion spring for biasing the hair gripping portions into either an open or a closed position.

8 Claims, 8 Drawing Sheets

ADJUSTABLE HAIR HOLDING DEVICE

CROSS-REFERENCE TO RELATED APPLICATION(S)

This application claims the benefit of U.S. Provisional Application No. 60/442,205, filed Jan. 24, 2003; U.S. Provisional Application No. 60/444,926, filed Feb. 4, 2003; U.S. Provisional Application No. 60/472,953, filed May 23, 2003 and U.S. Provisional Application No. 60/486,485, filed Jul. 11, 2003.

FIELD OF THE INVENTION

The present invention relates to hair holding and hair styling devices in which a first body and a second body are pivotally connected and are operable to grippingly engage a quantity of gathered hair strands.

BACKGROUND OF THE INVENTION

Hinged, spring-biased devices for use in holding human hair are known in the art. Devices of this kind have been used for many years, and an early example is described in U.S. Pat. No. 2,201,719. Such devices typically comprise a pair of opposed, hingedly connected members each including hair gripping portions and handle portions. The gripping portions are biased into a closed or gripping position by a biasing means, most commonly a torsion spring, that exerts a closing force on the members. To deploy the device, the user squeezes the finger-pressable handle portions to overcome the biasing force of the biasing means and thereby separate the hair gripping portions. While maintaining the squeezing force, the user places the hair gripping portions on opposite sides of a desired quantity of hair to be held by the device. The user then releases the handle portions and the torsion spring urges the hair gripping portions into gripping contact with a lock or shock of gathered hair.

A drawback of hair holding devices of the type described above is their failure to remain in the intended position about the user's hair. Additionally, presently available spring biased hair holding devices do not permit a user to adjust the device to hold hair more or less tightly than the torsion force generated by the device's biasing spring. In other words, the looseness or tightness with which spring biased hair holding devices of the prior art secure hair is determined by factors beyond the user's control, i.e., those related to the user's hair type such as thickness, texture, length, etc. and/or the spring force or torque of the torsion biasing spring.

After securing hair as described above, in an attempt to urge the gripping portions to secure the hair even more tightly, the user of the device quite often manually squeezes the hair gripping portions inwardly toward one another. This causes a temporary compression of the clasped hair to achieve the user's desired hair-securing position. However, when the gripping members are released, the compressed hair exerts expansion force in opposition to the momentary supplemental compression exerted by the user. Accordingly, the expanding lock or shock of hair urges the gripping portions of the hair gripping means to recoil from the user's desired hair-securing position to their original position as dictated by the torsion force of the biasing spring.

The biasing force of the biasing means directly impacts the looseness or tightness with which hair holding devices of the prior art secure hair and it is pre-determined by a particular device's manufacturer. Such a pre-determined biasing force setting may be optimal for some users, but not for others. In sum, hair holding devices of the prior art do not enable a user to control and/or set the looseness or tightness with which such devices secure hair. Their failure to do so reduces the utility and appeal of those devices to many users.

Barrettes and similar devices are also known in the art. However, they too are limited in the range of hair gripping force that they can provide. Generally, they offer one or, at most, a very few factory-set closure positions. If none of those predetermined positions is compatible with a particular user's needs and/or hair characteristics, then they are of little practical value. See, for example, the hair holding device in U.S. Pat. No. 6,082,371. In addition, many of these sorts of devices generally comprise two members hingedly connected at one end of the device. Displaced from the hinge, the opposite end of the device is fitted with a latch, catch, snap or similar fastener or closure. Such a fastener can become entangled with the user's hair, thereby possibly damaging the user's hair and even the user's fingers when the device is attempted to be removed from the hair. See, for example, the hair holding devices described in U.S. Pat. Nos. 5,196,429; 5,396,91; 5,996,593; 6,089,240; 6,257,249 and 6,311,699.

An advantage exists, therefore, for a hinged hair holding device including means for enabling a wide range of user-selectable adjustment or control of the tightness and/or looseness with which the gripping portions of the device secures a user's hair.

A further advantage exists for a hinged hair holding device that eliminates the requirement for a dedicated fastener or closure displaced from the device's hinge axis to secure the device about the user's hair and thereby reduces the likelihood of entanglement with a user's hair and resultant damage to a user's hair or fingers.

SUMMARY OF THE INVENTION

In contrast to hair holding devices of the prior art, the hair holding device of the present invention is designed to enable the user to influence and/or control how tightly or loosely the device secures hair between the hair gripping portions of its body members. The present invention overcomes the deficiencies of the prior art by providing methods and means for utilizing mechanical interference, resistance or friction to enable hingedly connected hair gripping means to remain at a desired hair-securing position after having been manually squeezed inwardly together into such position by a user. In so doing, the present invention provides improved hair holding devices which hold hair more tightly and for a longer period of time. In all embodiments of the invention, there is provided a hair holding device comprising a pair of opposed body members each including hair gripping portions and hinged coupling means for allowing the opposed body members to pivot relative to each other about a hinge axis between a spread apart position and a user-selectable hair gripping position.

According to the invention, adjustment means are preferably provided for enabling the hair gripping portions of the first and second members of the hair holding device to remain at an arbitrary point (typically the closest point) to which the hair gripping portions are manually squeezed together by a user, whereby the user may optimally secure gathered strands of hair between the hair gripping portions without slippage. The adjustment means are arranged coaxially with the hinge means and may be constructed such that they impart incremental motion to the hair gripping portions such that the user experiences, tactilely and/or audibly, a "click-by-click" sensation as the gripping members are being closed about the gathered hair. Alternatively, they may constructed in such manner as to impart smooth continuous motion to the hair gripping portions as they are closed.

The first and second body members of the hair holding device may or may not include finger-pressable handle portions by which a user may manipulate the hair gripping portions. And, a torsion or other type of spring may be provided for biasing the hair gripping portions toward an open or a closed position. The device may further comprise disengagement means for releasing the hair gripping portions from the user's hair.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
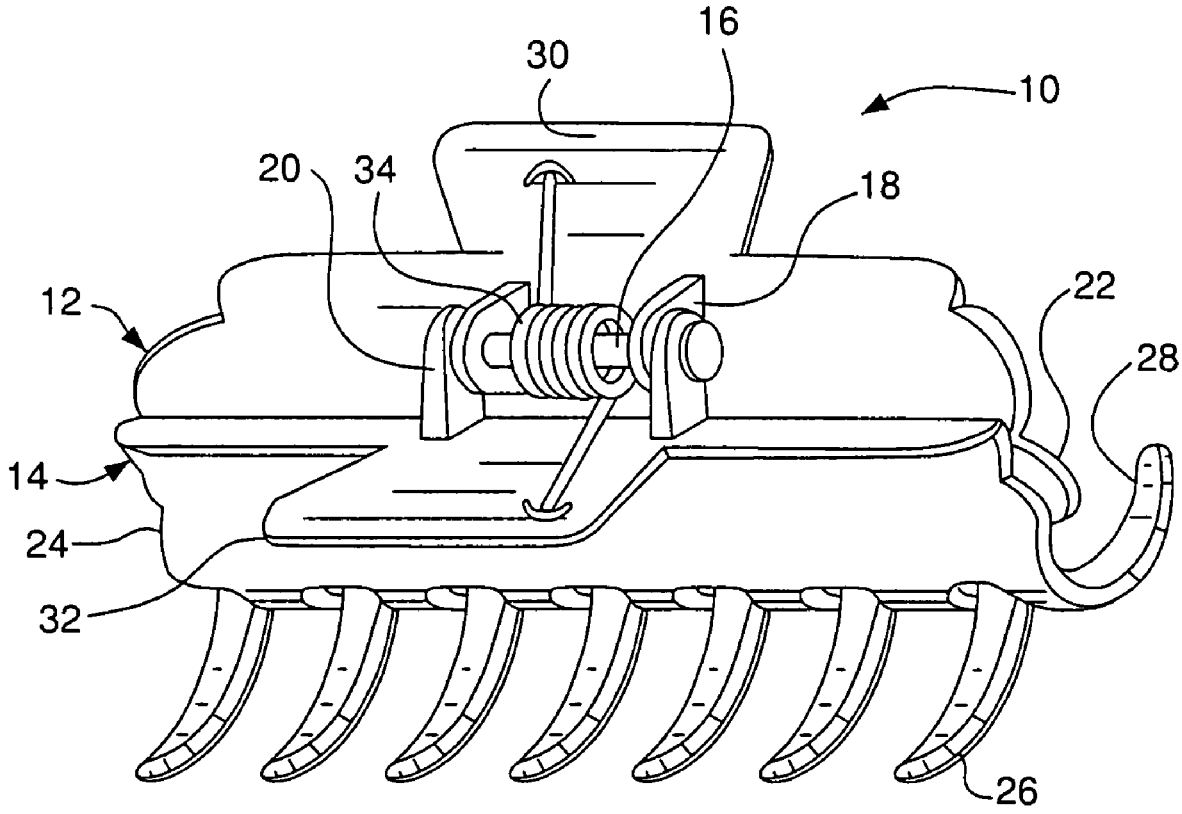
FIG. 1 PRIOR ART
FIG. 1 is a perspective view of a conventional hinged and spring-biased hair holding device.

Disclosed in FIG. 1 is a typical spring biased hair-holding device 10 comprising a pair of rigid body members 12 and 14 that are pivotally connected by a hinge pin 16 that passes through cooperating connecting lugs 18 and 20 carried by the rigid members. Members 12, 14 comprise handle portions 30 and 32 and hair gripping portions 22 and 24 which terminate in a plurality of interdigitated hair-engaging fingers or tines 26 and 28, respectively. Normally, a torsion spring 34 is disposed about the hinge pin 16. As is known in the art, the torsion spring is pre-stressed upon assembly of device 10 such that the projecting arms at its opposite ends exert force against the handle portions 30, 32 to urge the members 12, 14 into the illustrated closed position.

When a user wishes to don device 10, the user presses or squeezes handle portions 30, 32 inwardly together whereby the hair-gripping portions 22, 24 and tines 26, 28 hingedly separate toward an unillustrated open position for receiving gathered strands of the user's hair. When the user releases the handle portions 30, 32, torsion spring 34 urges handle portions to move rotationally inwardly into a hair-gripping position, thereby causing the user's hair to be secured within the hair-gripping portions 22, 24 and their tines 26, 28.

After securing hair with device 10 as described above, a user frequently discovers that the device does not remain securely positioned at the desired location on the hair. Frequently, therefore, the user attempts to secure the hair even more tightly by manually squeezing gripping portions 22, 24 inwardly toward one another. This causes the hair gripping portions and their tines to move closer together and compress the hair contained therein to achieve the user's desired hair-securing effect. However, when the hair gripping portions 22, 24 are released, the compressed hair exerts expansion force in opposition to the temporary over-compression of the hair gripping portions exerted by the user. The expansion force generated by the gathered hair urges the hair gripping portions to recoil from the user's desired hair-securing state to their original pre-squeezed state whereby the device may become easily displaced from the user's desired hair-securing position.

Referring to FIGS. 2-5, there is shown a first embodiment of a hair holding device and friction-type adjustment mechanism constructed in accordance with the present invention. The device, identified generally by reference numeral 110, comprises a pair of rigid body members 112 and 114 that are pivotally connected by a hinge pin 116 that passes through cooperating connecting lugs 118 and 120 carried by the rigid members. Members 112, 114 respectively comprise handle portions 130 and 132 and hair gripping portions 122 and 124 which terminate in a plurality of interdigitated hair-engaging fingers or tines 126 and 128. Reference numeral 134 represents an exposed gap for receiving an optional unillustrated torsion spring that may be disposed about the hinge pin 116. If present, the torsion spring is pre-stressed upon assembly of device 110 such that the projecting arms at its opposite ends exert force against the handle portions 130, 132 to urge the members 112, 114 into the illustrated closed position.

Figure 2:
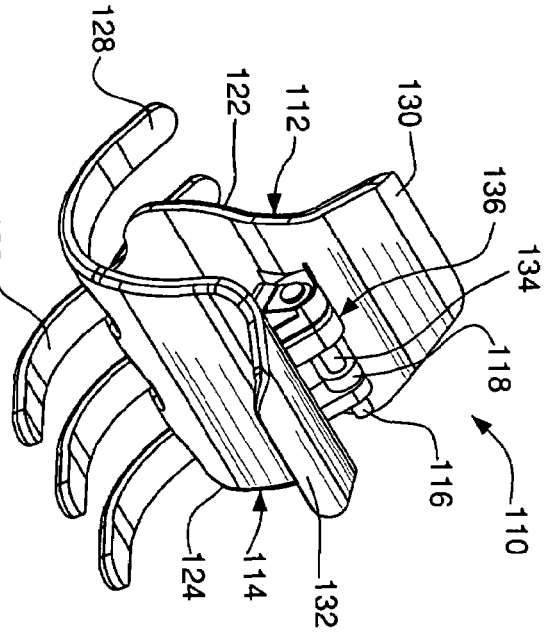
FIG. 2 is a perspective view of a hair holding device according to a first embodiment of the present invention in a fully closed position.
Figure 4:
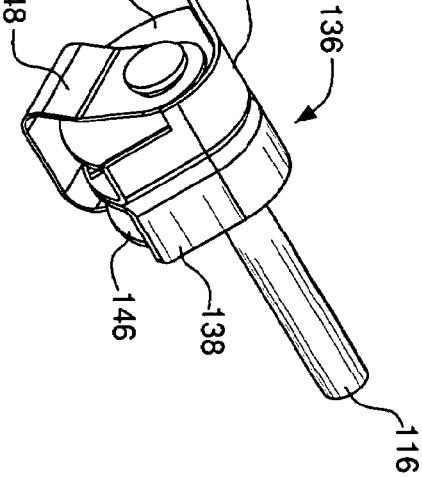
FIG. 4 is an enlarged perspective view of a pivot shaft and a first embodiment of friction-type adjustment means assembly according to the present invention.
Figure 5:
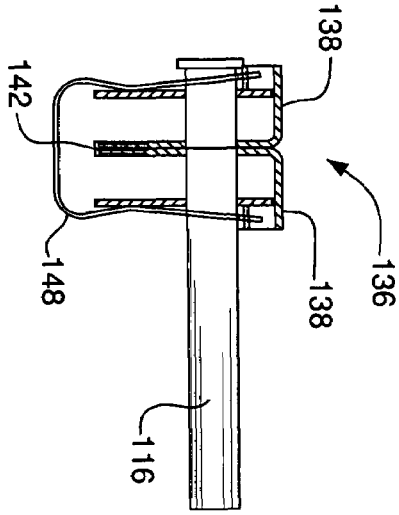
FIG. 5 is an elevation and partial section view of a pivot shaft and a first embodiment of friction-type adjustment means assembly of FIG. 4.

Identified generally by reference numeral 136 in FIGS. 2, 4 and 5 is a first embodiment of a friction-type adjustment mechanism according to the instant invention. All of the friction-type adjustment mechanisms disclosed herein and any equivalents thereof that may exist within the spirit and scope of the present invention are coaxially arranged with respect to the hinge means of their associated hair holding devices and produce sufficient friction force to cause the hair gripping portions of those devices to remain at a point at which the hair gripping portions are squeezed together by a user. Several advantages are manifested by such an arrangement. Notably, a hair holding device is provided which reliably remains where placed on a wearer's hair and that is less prone to entanglement. And, by positioning the adjustment means coaxially with the hinge means, a compact and aesthetically pleasing assembly may be produced.

The friction-type adjustment mechanism 136 and certain others described hereinafter may be suitably referred to as a "slip friction mechanism." As used herein, the term "slip friction mechanism" shall mean an assembly which is derivative of a ratchet and a slip friction disk clutch assembly. It is derivative of a ratchet in that it is used to progressively tighten the hair gripping portions 122, 124 about a lock or shock of hair as described below. And, it is derivative of a slip friction disk clutch assembly in that the position into which the wearer squeezes the hair gripping portions 122, 124 may be overcome by a rotational force which exceeds the friction force of adjustment mechanism 136, similar to the manner in which a friction clutch slips when the torque applied to the clutch is too great (although, unlike a friction clutch, the various slip friction mechanisms described herein are passive in nature, i.e., they do not serve to drive any parts of the hair holding device). The slip friction mechanisms of the present invention comprise a first surface associated with a first body member (e.g., body member 112), a second surface associated with a second member (e.g., second body member 114), and biasing means for maintaining contact between the first and second surfaces whereby a slip friction interface is created between the first and second surfaces. The shear or friction force generated at the slip friction interface must be sufficient in all instances (regardless of whether a torsion spring or other body member biasing means is present) to cause the body members to remain in the desired hair holding position selected by the user until such time that the user chooses to doff the device by applying a rotational opening force that exceeds the friction or shear force at the slip friction interface.

All friction-producing elements described herein must be capable of generating friction on or at at least one surface thereof. Means for generating friction may include an irregular surface such as, for example, a roughened surface, a textured surface or a knurled or toothed surface. Additionally, the toothing of a toothed friction generating means may be asymmetrical in slope, i.e., a saw-tooth design, whereby the ability of a hair holding device according to the invention to secure compressed hair is even further enhanced to maintain an optimal hair-securing position, while still being easy to open and close for the user. Moreover, the friction means can be designed to produce shear or friction force that is random, continuous, regressive or progressive throughout its rotational arc between the open and closed positions of a hair holding device's body members. For friction producing elements that are not rigid but possess inherent friction-producing qualities, e.g., elastomers such as natural and artificial rubber and rubber-like compounds, such elements may be appropriately selected such that they produce a degree of friction or shear force that is sufficient to securely retain the a hair holding device about a wearer's hair.

Furthermore, the embodiments of the invention illustrated herein are constructed with the friction interface extending perpendicular to the hinge means. However, the present invention is not so limited. It is also contemplated that the friction interface, whether a slip friction interface or a non-slip friction interface as described hereinafter, may extend parallel to the hinge means. For instance, one of the hair holding device's body members may include a shaft extending coaxially with the hinge axis (and possibly serving as a hinge pin) that is received in a cylindrical lug carried by the other body member. In such an arrangement, the outer surface of the shaft and the inner surface of the lug may have cooperating irregular, high-friction or otherwise interfering surfaces that achieve the desired friction interface. And, to maintain and even enhance the surface contact force at such an interface, either the shaft or the lug may be longitudinally slit and the other of the shaft or the lug may be appropriately sized to exert a pre-stressing force on the slitted member whereby the interfering members together function as biasing means for maintaining contact at the friction interface. For example, the cylindrical lug may be longitudinally slit and the shaft may be somewhat radially oversized relative to the cavity of the lug whereby the shaft exerts a radially outwardly directed expansion force to slightly spread the walls of the lug. Conversely, the shaft may be longitudinally slit and the cavity of the lug may be somewhat radially undersized relative to the shaft whereby the lug exerts a radially inwardly directed compression force to slightly close the slitted shaft.

Figure 3:
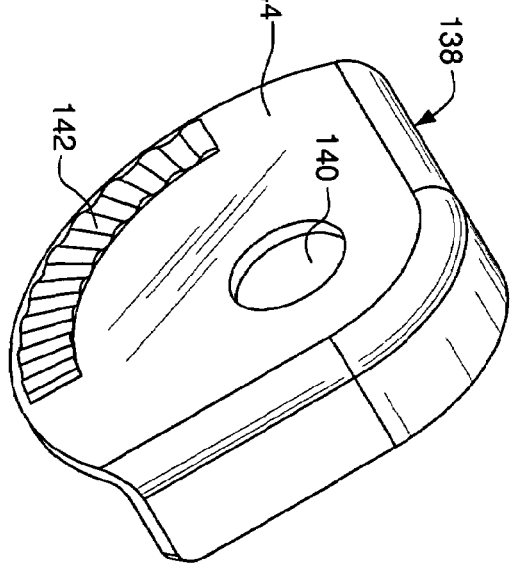
FIG. 3 is an enlarged perspective view of a component of a first embodiment of friction-type adjustment means of a hair-holding device according to the present invention.

As seen in the enlarged view of FIG. 3, slip friction adjustment mechanism 136 comprises at least one friction-producing element 138 having an opening 140 for receiving hinge pin 116 in the manner most clearly depicted in FIGS. 4 and 5. The friction-producing element 138 may be in the form of a rigid plate or disk and includes friction generating means in the form of an irregular surface 142 provided on at least a portion of face 144 thereof. By way of illustration but not limitation, irregular surface 142 may be a toothed surface. The irregular surface may be formed into friction-producing element 138 or it may be provided as a separate member that is applied to face 144 thereof. Moreover, it is also contemplated that there need not be friction-producing elements separate from the essential components of the hair holding device itself. That is, the hinge pin itself or one or both sets of the cooperating hinge pin receiving lugs of the device may be provided with integral friction-producing elements or surfaces and the tolerance between their friction producing surfaces may be made sufficiently close or tight that the limited flexibility of the structural elements themselves serves as biasing means for keeping the friction producing surfaces thereof in contact with one another. Still further, although all illustrated embodiments of the present invention show a hinge means comprised of a hinge pin that is received in cooperating lugs carried by a hair holding device's cooperating body members, it is also contemplated that the body members may be selected from suitable plastic materials and may be joined to one another during a plastic molding process to produce a flexible joint between them that is commonly referred to as a "living hinge." In that event, any suitable friction producing elements may also be formed concurrently with the device or installed thereafter, so long as they extend coaxially with the axis of the living hinge.

Referring to FIGS. 4 and 5, it will be seen that slip friction adjustment mechanism 136 preferably comprises a pair of friction-producing elements 138 in facing relationship with their irregular surfaces 142 in contact with one another. The contacting face portions of elements 138 are preferably inserted between corresponding lugs 118, 120 (not illustrated in FIGS. 4 and 5) of the first and second body members 112, 114 such that their hinge pin receiving openings are in alignment with those of the lugs. Optional thrust or wear plates 146 may be provided at the opposite faces of the lugs for bearing the axial compressive or thrust force of the legs of a generally U-shaped metal spring clip biasing means 148 that maintains contact between the irregular surfaces 142. In order to effectively retain the spring clip 148 in compressive contact with the lugs and on hair holding device 110 itself, it is preferred that the opposed legs of the clip be long enough that they extend past hinge pin 116 and include aligned openings for receiving the pin.

When a user wishes to don device 110, the user presses or squeezes handle portions 130, 132 inwardly together whereby the hair gripping portions 122, 124 and tines 126, 128 hingedly separate toward an unillustrated open position for receiving gathered strands of the user's hair. The user then squeezes hair gripping portions 122, 124 toward one another into a desired hair gripping position about the gathered strands of the user's hair. As the user does this, the force exerted by the user overcomes the shear or friction force generated at the slip friction interface created by opposed irregular surfaces 142. Adjustment mechanism 136 is thus constructed such that it imparts incremental motion to the hair gripping portions whereby the user experiences, tactilely and/or audibly, a "click-by-click" sensation as the gripping members are being closed about the gathered hair. Alternatively, as described above, a slip friction adjustment mechanism utilizing generally smooth but inherently high-friction material (e.g., natural or artificial rubber or rubber-like compounds) at one or both contacting surfaces of the slip friction interface may be used. So constructed, the adjustment mechanism would impart smooth continuous motion rather than incremental motion to the hair gripping portions 122, 124 as they are closed toward one another. In either case, once in the chosen hair-clamping position, the slip friction adjustment mechanism retains the hair holding device in that position against the expansion force of the gathered hair until the user chooses to remove the device by again squeezing handle portions 130, 132 inwardly together until they achieve their open, hair-releasing position.

Figure 6:
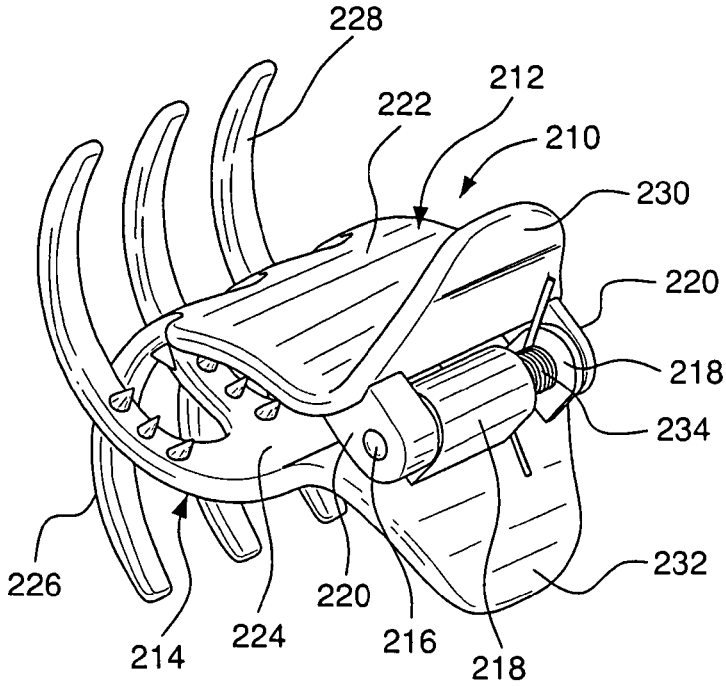
FIG. 6 is a perspective view of a hair holding device according to a further embodiment of the present invention in a fully closed position.
Figure 7:
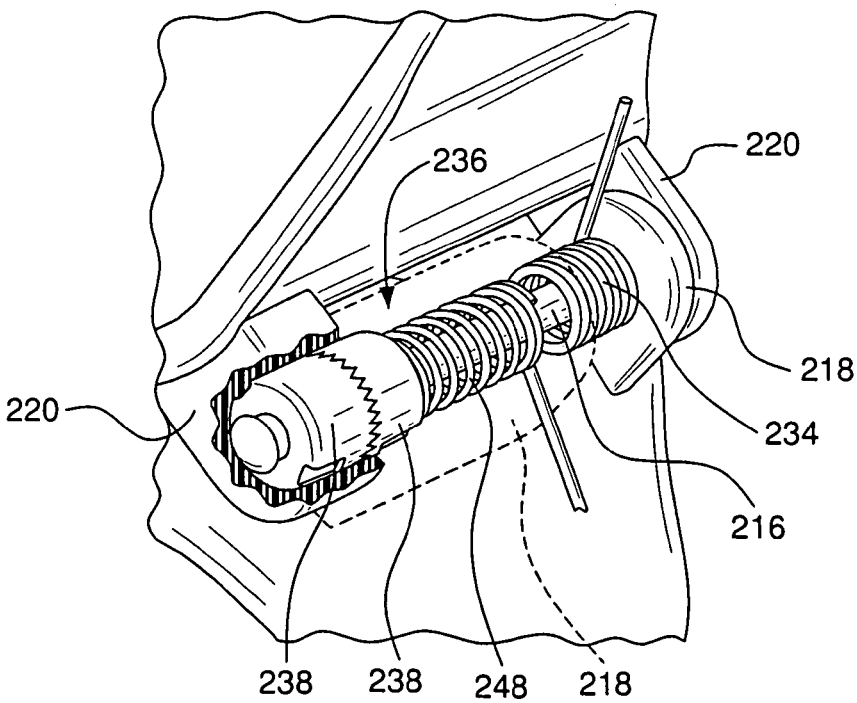
FIG. 7 is an enlarged perspective and partially-cut view of the hinged connection and friction-type adjustment means of the hair-holding device of FIG. 6.
Figure 8:
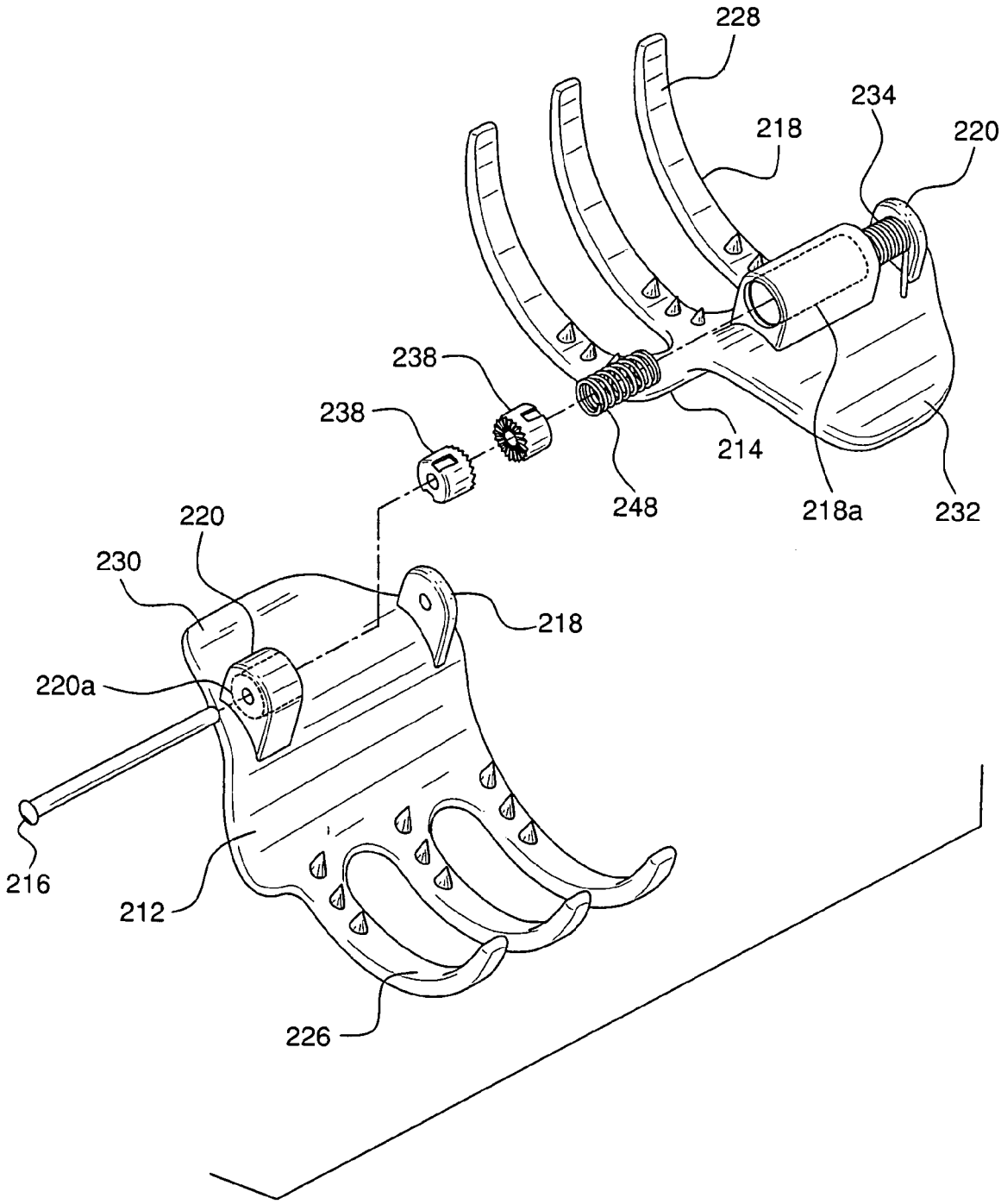
FIG. 8 is an exploded view of the hair-holding device of FIG. 6.

Referring to FIGS. 6-8 there is shown a further embodiment of hair holding device and friction-type adjustment mechanism constructed in accordance with the present invention. The device, identified generally by reference numeral 210, comprises a pair of rigid body members 212 and 214 that are pivotally connected by a hinge pin 216 that passes through cooperating connecting lugs 218 and 220 carried by the rigid members. Members 212, 214 respectively comprise handle portions 230 and 232 and hair gripping portions 222 and 224 which terminate in a plurality of interdigitated hair-engaging fingers or tines 226 and 228. A torsion spring 234 is disposed about the hinge pin 216. As is known in the art, the torsion spring is pre-stressed upon assembly of device 210 such that the projecting arms at its opposite ends exert force against the handle portions 230, 232 to urge the members 212, 214 into the illustrated closed position of FIG. 6. A user dons and doffs device 210 in the same manner as device 110 described above.

Figure 9:
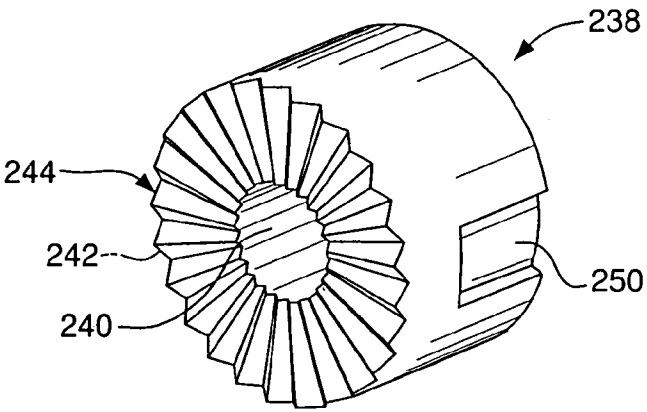
FIG. 9 is an enlarged perspective view of a component of the friction-type adjustment means of the hair-holding device of FIG. 6.

Identified generally by reference numeral 236 in FIG. 7 is a further presently contemplated embodiment of a slip friction adjustment mechanism according to the instant invention. In order to clearly convey the structure and function of adjustment mechanism 236, certain elements thereof appear in broken or dashed line. As seen in FIGS. 6-8, at least one pair of connecting lugs 218, 220 is axially elongated. FIG. 8 shows that the at least one elongated pair of lugs 218, 220 respectfully define sockets 218*a* and 220*a*. According to this embodiment, each of sockets 218*a*, 220*a* is adapted to receive one of a pair friction-producing elements 238 constructed in the form cylindrical inserts. Although shown as being right circular cylindrical in shape, sockets 218*a*, 220*a* and inserts 238 may assume any rectilinear and/or curvilinear shape. One of the inserts 238 is shown enlarged in FIG. 9. In that figure it is seen that insert 238 includes an opening 240 for receiving hinge pin 216. Insert 238 includes friction generating means in the form of an irregular surface 242 provided on at least a portion of face 244 thereof. By way of illustration but not limitation, irregular surface 242 may be a toothed surface. The irregular surface may be formed into friction-producing element 238 or it may be provided as a separate member that is applied to face 244 thereof. If formed as circular cylinders, inserts 238 preferably include means 250 for preventing rotation of the inserts relative to their corresponding sockets 218*a*, 220*a*. As illustrated, means 250 may be one or more notches which engage with one or more correspondingly shaped and arranged protrusions provided on the interior surface(s) of sockets 218*a*, 220*a*. Alternatively, the relative dispositions of the notches and protrusions may be reversed. Still further, if the inserts 238 and their corresponding sockets 218*a*, 220*a* are anything other than right circular cylindrical in shape, there is no need to provide supplemental means for preventing rotation of the insert with respect to its associated socket.

FIG. 7 most clearly shows the biasing means 248 which maintains contact between the irregular surfaces 242 of the friction-producing inserts 238. In this case, biasing means 248 is a compression spring which abuts, in pre-stressed condition, the rear wall of one of the inserts 238 and the closed end of socket 218*a*. It will be understood that the relative lengths of the elongated lugs 218, 220 and their corresponding sockets 218*a*, 220*a* may be reversed, as can the position of compression spring 248 (i.e., it can be situated within lug 220 rather than 218. Similarly, both of lugs 218 and 220 may contain a compression spring 248. Likewise, one of the lugs 218 or 220 may contain a compression spring 248 and insert 238 and the other of the lug may be monolithic with an irregular, friction-producing surface formed thereon or applied thereto.

As seen by the contrast between the first and second embodiments of the invention thus far described, the provision of torsion spring is optional. Whereas the torsion spring of conventional hair holding devices is typically not powerful enough to enable the devices to optimally secure hair, a torsion spring in combination with any of the friction-type adjustment means according to the invention is able to do so. The instant friction-type adjustment means produces force to supplement that of a torsion spring or any other type of biasing means in order to render a hair holding device better able to firmly secure a lock or shock of hair. That is, the friction producing means supply additional force needed to overcome the expansion force exerted by hair when compressed between the device's hair-gripping means. While it is possible that one could manufacture a hair holding device with a more powerful torsion spring having torque sufficient to better secure hair, such a device may not be capable of being opened by physically weak individuals. And, for others of even ordinary physical strength, opening and closing of the device would inordinately tire the user's fingers, thereby reducing the utility and appeal of the device.

Hair holding devices of the present invention may or may not have handles or other means to facilitate a user's opening of the devices. Indeed, in each of the above described embodiments, the first and second body members may be constructed without handle portions to assist the user in opening the device. Should such opening assistance means be absent, the user of the device may manually pull, pry or otherwise urge the first body and second body members toward a spread apart position. However, when handle portions of the kinds described above are not present, it is preferred that the hair holding devices according to the invention be provided with disengagement means for opening the device from its hair-gripping position such as is described below.

Figure 11:
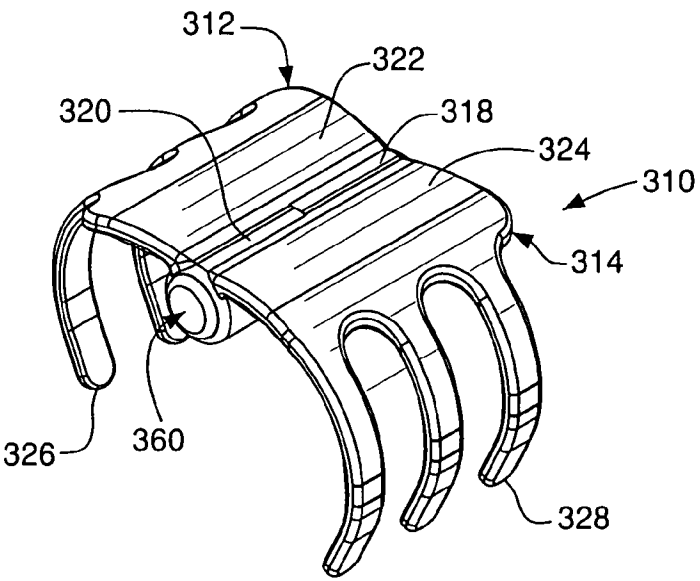
FIG. 11 is a perspective view of the hair holding device of FIG. 10 in a fully open position.
Figure 10:
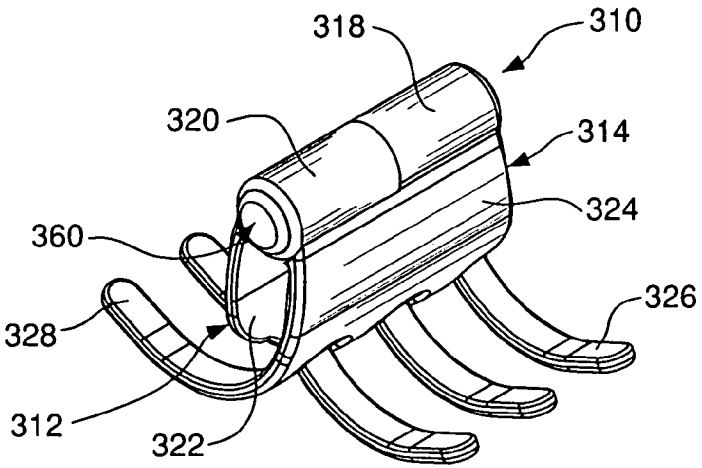
FIG. 10 is a perspective view of a hair holding device according to a further embodiment of the present invention in a fully closed position.

Referring to FIGS. 10 and 11 there is shown a further embodiment of a hair holding device and friction-type adjustment mechanism constructed in accordance with the present invention in fully closed and fully opened positions, respectively. The device, identified generally by reference numeral 310, comprises a pair of rigid body members 312 and 314 that are pivotally connected by a disengagement means and friction-type adjustment mechanism (described below) which pass through connecting lugs 318 and 320 carried by the rigid members. Members 312, 314 comprise hair gripping portions 322 and 324, respectively, which terminate in a plurality of interdigitated hair-engaging fingers or tines 326 and 328. Identified generally by reference numeral 360 in FIGS. 10 and 11 is a presently contemplated embodiment of a disengagement means that operates to release friction-type adjustment mechanism. An advantage of device 310 is that it fully covers torsion spring or other biasing means, which spring tends to render a hair holding device prone to hair-snagging and damaging to hair and fingers.

Figure 12C:
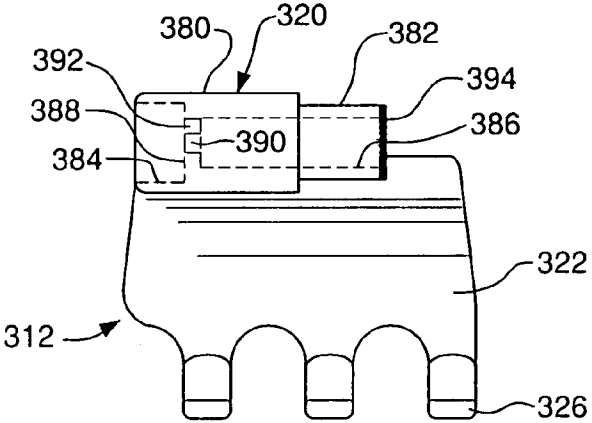
FIGS. 12A, 12B and 12C are inside perspective, end elevational and inside elevational views, respectively, of a first body member of a hair holding device according to a further embodiment of the present invention.
Figure 12B:
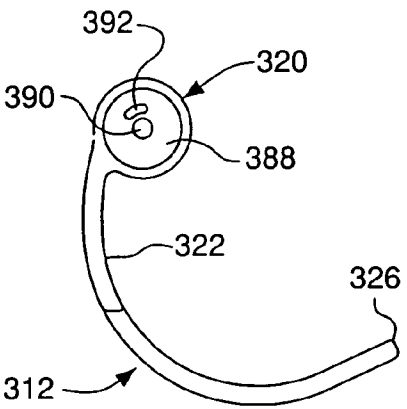
Figure 12A:
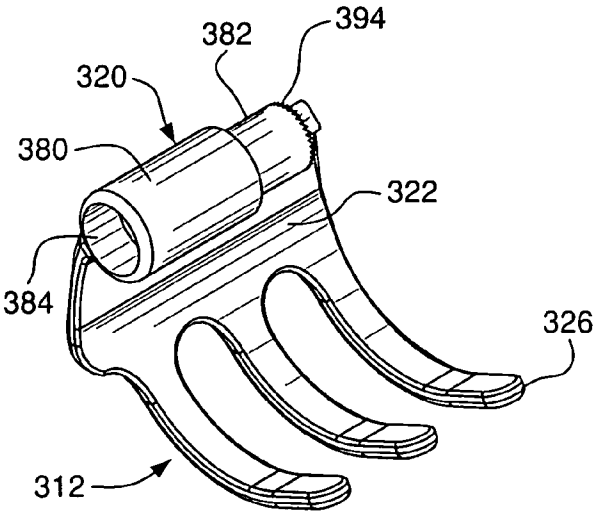
Figure 15:
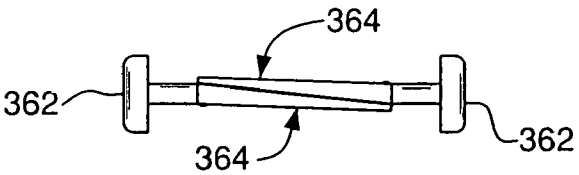
FIG. 15 is a side elevation view of a partially assembled disengagement mechanism of the hair holding device of FIG. 10.
Figure 17:
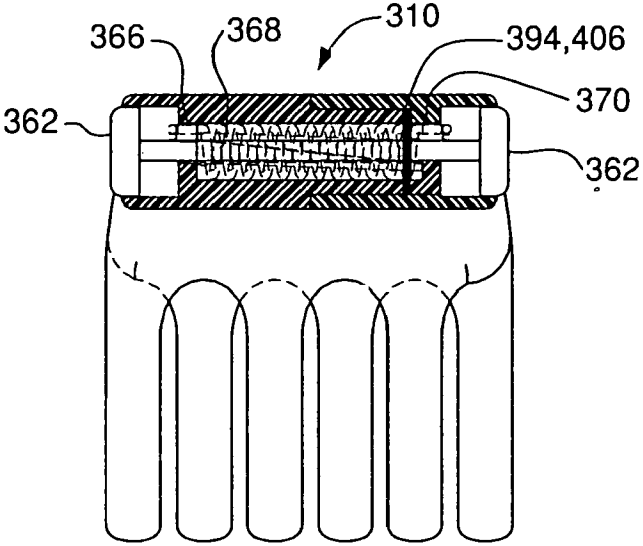
FIG. 17 is a partially-cut side elevation view of a fully assembled hair holding device of FIG. 10.
Figure 16:
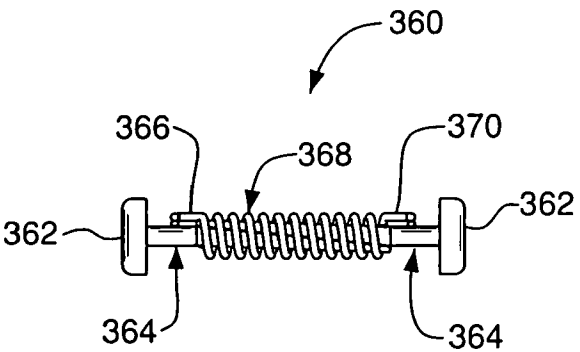
FIG. 16 is a side elevation view of a fully assembled disengagement mechanism of the hair holding device of FIG. 10.

FIGS. 12A-12C depict several views of a first body member 312 of hair holding device 310. According to this embodiment, lug 320 is formed as an elongated cylinder having a first comparatively larger diameter portion 380 and a second comparatively smaller diameter portion 382. Portions 380 and 382 have sockets and other openings which cooperate with the second body member 314 and disengagement mechanism 360, both of which are described in detail in FIGS. 13-17. More particularly, at its outer end, portion 380 has a first socket 384 for slidably receiving an enlarged push button head 362 of a first actuator 364 of disengagement means 360 (FIGS. 14-16). A second socket 386 is provided partly in portion 380 and portion 382 and it receives a central portion of disengagement means 360. A wall 388 separates the first and second sockets 384 and 386. As seen in FIGS. 12B and 12C, wall 388 includes a central opening 390 and a radially displaced opening 392. As illustrated in FIG. 17, central opening 390 receives a shaft portion of a first actuator 364 of disengagement means 360 and radially displaced opening 392 receives a first end 366 of a tension spring 368 of the disengagement means. The exposed end of portion 382 of lug 320 is either formed or provided with a friction-producing means or surface 394 which may be selected from any of the kinds mentioned hereinabove. In the alternative, portion 382 may be constructed as a friction-producing insert received within portion 380 of lug 320.

Figure 13C:
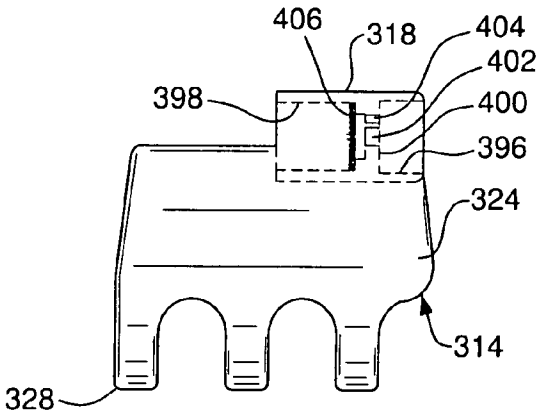
FIGS. 13A, 13B and 13C are outside perspective, end elevational and outside elevational views, respectively, of a first body member of a hair holding device according to a further embodiment of the present invention.
Figure 13B:
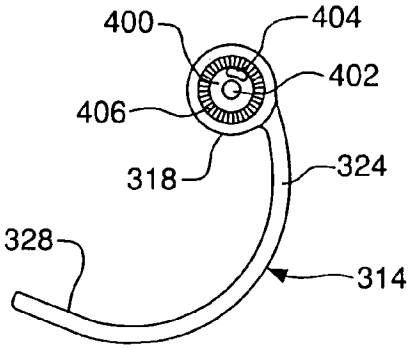
Figure 13A:
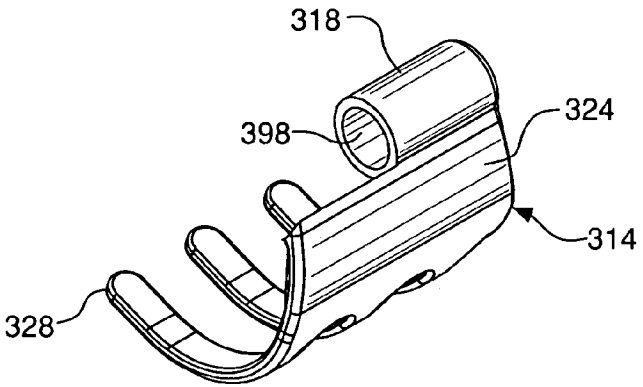
Figure 14:
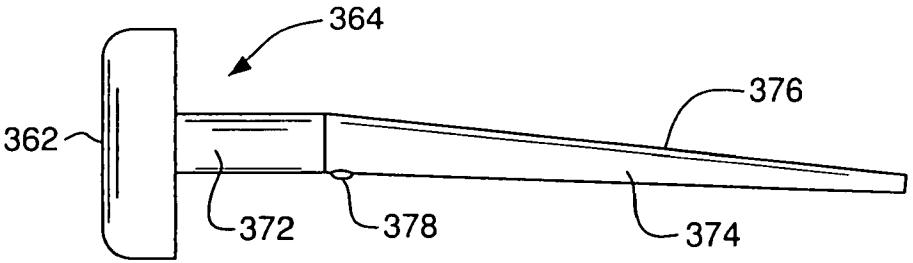
FIG. 14 is an enlarged side elevation view of a component of a disengagement mechanism of the hair holding device of FIG. 10.

Turning to FIGS. 13A-13C, the construction of second member 314 of hair holding device 310 is shown. Similar to portion 380 of lug 320, lug 318 has a first socket 396 for slidably receiving an enlarged push button head 362 of a second actuator 364 of disengagement means 360 (FIGS. 14-16). A second socket 398 is provided in lug 318 for receiving portion 382 of lug 320 (see assembled device in FIG. 17). A wall 400 separates the first and second sockets 396 and 398. As seen in FIGS. 13B and 13C, wall 400 includes a central opening 402 and a radially displaced opening 404. As seen in FIG. 17, central opening 402 receives a shaft portion of a second actuator 364 of disengagement means 360 and radially displaced opening 404 receives a second end 370 of a tension spring 368 of the disengagement means. The exposed inner face of wall 400 is either formed or provided with friction-producing means or surface 406 which may be selected from any of the kinds mentioned hereinabove. In the alternative, lug 318 may be provided with a friction-producing insert received within socket 398. An advantage of the construction of the hair holding device 310 of FIGS. 10-13 is that it provides an articulated cover, including cooperating male and female members, which fully encloses the device's biasing means. An additional advantage of hair holding device 310 is that by lacking finger-pressable handle portions, the hair gripping portions thereof are capable of opening wider and being of greater length than comparable structures heretofore known in the art.

The friction-producing surfaces 394 of lug 320 and 406 of lug 318 are adapted for generating a high degree of shear force when brought into engagement with one another by disengagement means 360. Indeed, the friction-producing surfaces 394 of lug 320 and 406 of lug 318, in cooperation with disengagement means 360 produce a friction-type adjustment mechanism 136 that may be suitably referred to as a "non-slip friction mechanism." As used herein, the term "non-slip friction mechanism" shall mean an assembly which is derivative of a ratchet and a non-slip friction disk clutch assembly. It is derivative of a ratchet in that it is used to progressively tighten the hair gripping portions 322, 324 about a lock or shock of hair. And, it is derivative of a non-slip friction disk clutch assembly in that the position into which the wearer squeezes the hair gripping portions 322, 324 may not be readily overcome by a rotational force exerted by a user (although, unlike a friction clutch, the various non-slip friction mechanisms described herein are passive in nature, i.e., they do not drive any shaft or other parts of the hair holding device). The non-slip friction mechanisms of the present invention comprise a first surface associated with a first body member (e.g., body member 312), a second surface associated with a second member (e.g., second body member 314), and biasing means for maintaining contact between the first and second surfaces whereby a non-slip friction interface is created between the first and second surfaces. The shear or friction force generated at the non-slip friction interface must be sufficient in all instances to cause the body members to remain in the desired hair holding position selected by the user until such time that the user chooses to doff the device by releasing them using the disengagement means 360 as described below.

Referring to FIGS. 14-16, each actuator member 364 of disengagement means 360 is preferably substantially symmetrical in configuration. Actuator member 364 preferably comprises the aforementioned enlarged push button head 362 which is disposed at one end of a central shaft 372. On the opposite end of central shaft 372 is an actuator shaft 374 having a sloped surface 376. As seen most clearly in FIG. 15, the sloped surfaces of the actuator shafts are brought into contact with one another to create mutually cooperating camming surfaces for guiding the actuator shafts of the opposed actuators into actuating contact with the lugs 318 and 320 as will be described in connection with FIG. 17. It is also desirable that each actuator member 364 be provided with a protrusion 378 for engaging the inner surface of wall 388 or wall 400 for retaining the actuator member within its respective lug 318, 320. The fully assembled disengagement means 360 is shown in FIG. 16 wherein the actuator members 364 are situated within tension spring 368. Upon assembly of the entire device 310, the first and second ends 366 and 370 of tension spring 368 are pre-stressed in opposite directions whereby a torque is induced in the tension spring which biases the hair gripping means into the open condition shown in FIG. 11 and the friction producing surfaces 394 and 406 of lugs 320 and 318 are in firm contact as shown in FIG. 17.

Turning to FIG. 17, a fully assembled hair holding device 310 is shown as it would appear in hair-gripping position about a wearer's hair. To achieve that position, the user gathers the desired strands of hair and squeezes the hair gripping portions of the device about the hair in opposition to the pre-stressed torque of tension spring 368. When the user desires to release the device, the user merely presses the push buttons 362 inwardly toward one another whereby the tips of the actuator shafts 374 press against the inner faces of walls 388 and 400. As the user continues to squeeze the buttons 362, the friction producing surfaces 394 and 406 of lugs 320 and 318 become separated from one another. When axial clearance exists between the friction producing surfaces 394, 406, the torque which was built up in spring 368 when the user initially squeezed hair gripping portions 322, 324 about her hair is released and the device is returned to the open position shown in FIG. 11.

The non-slip friction interface between the friction producing surfaces 394, 406 is preferably not so great that the user cannot overcome its shear or friction force by manually pulling or prying the hair gripping portions 322, 324 apart in the event the disengagement means 360 should fail. That is, while the non-slip friction interface desirably provides substantially greater resistance to opening torque than its slip friction interface counterparts described hereinabove, its resistance to opening torque should not prevent users from removing device 310 from their hair without the assistance of others.

Device 310 is not provided with handles as some wearer's consider them to be unsightly and/or difficult to use, and also because disengagement means 360 obviates their utility. Nevertheless, device 310 could be provided with handles in the event certain wearers find them aesthetically and/or functionally pleasing. Alternatively, handles would be desirable if device 310 were provided with a slip friction interface rather than a non-slip friction interface between friction producing surfaces 394 and 406 of lugs 320 and 318 and/or disengagement means 360 were not present.

The present invention provides method and means applicable to the universe of hair holding devices including but not limited to those described in the aforementioned U.S. Pat. Nos. 2,210,719; 5,396,912; 5,996,593; 6,082,371; 6,089,240; 6,257,249 and 6,311,699 as well other such devices that are well known in the art (including but not limited to jaw clips, claw clips, butterfly clips, barrettes and banana clips).

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. A hair holding device comprising:

a first body member and a second body member, said first and second body members comprising hair gripping portions adapted to be squeezed by a user whereby said hair gripping portions come into contact with gathered strands of a user's hair;

hinge means for pivotally connecting said first and second body members; and adjustment means comprising a non-slip friction mechanism coaxially arranged with respect to said hinge means for causing said hair gripping portions to remain at a point at which said hair gripping portions are squeezed together by a user.

2. The hair holding device of claim 1 wherein said non-slip friction mechanism comprises a first irregular surface associated with said first body member, a second irregular surface associated with said second body member, and biasing means for maintaining contact between said first and second irregular surfaces such that a non-slip friction interface is created between said first and second surfaces.

3. The hair holding device of claim 2 wherein said non-slip friction interface extends perpendicular to said hinge means.

4. The hair holding device of claim 2 wherein said first and second irregular surfaces are mating toothed surfaces.

5. The hair holding device of claim 2 wherein said biasing means comprise a tension spring having a first end in contact with said first body member and a second end in contact with said second body member for biasing said hair gripping portions into a predetermined position.

6. The hair holding device of claim 2 further comprising disengagement means for releasing contact between said first and second irregular surfaces in opposition to a biasing force of said tension spring to permit removal of said device from a user's hair.

7. The hair holding device of claim 2 wherein at least one of said irregular surfaces is integral with at least one of said first and second body members.

8. The hair holding device of claim 2 wherein at least one of said irregular surfaces is provided on at least one insert carried by at least one of said first and second body members.

* * * * *